US008079205B2

(12) United States Patent
Nava et al.

(10) Patent No.: US 8,079,205 B2
(45) Date of Patent: Dec. 20, 2011

(54) SPIRAL WINDING MACHINE WITH MOTORIZED COILS

(75) Inventors: Mauro Nava, Caponago (IT); Luigi Brambilla, Caponago (IT)

(73) Assignee: O.M.A. S.R.L., Caponago (MI) (IT)

( * ) Notice: Subject to any disclaimer, the term of this patent is extended or adjusted under 35 U.S.C. 154(b) by 231 days.

(21) Appl. No.: 12/600,014

(22) PCT Filed: Mar. 31, 2008

(86) PCT No.: PCT/EP2008/053787

§ 371 (c)(1),
(2), (4) Date: Nov. 13, 2009

(87) PCT Pub. No.: WO2008/141856

PCT Pub. Date: Nov. 27, 2008

(65) Prior Publication Data

US 2010/0300624 A1 Dec. 2, 2010

(30) Foreign Application Priority Data

May 18, 2007 (IT) ..... MI2007A1010

(51) Int. Cl.
*D02G 3/36* (2006.01)

(52) U.S. Cl. ..... 57/13

(58) Field of Classification Search ..... 57/10, 11, 57/13, 14, 15

See application file for complete search history.

(56) References Cited

U.S. PATENT DOCUMENTS

| | | | | |
|---|---|---|---|---|
| 2,802,328 | A * | 8/1957 | Ritchie | 57/13 |
| 3,138,511 | A | 6/1964 | Cadwallader | |
| 3,201,929 | A * | 8/1965 | Harris | 57/15 |
| 3,736,739 | A * | 6/1973 | Walter | 57/13 |
| 3,934,395 | A | 1/1976 | Vryland | |
| 4,317,328 | A * | 3/1982 | Allard | 57/59 |
| 4,947,637 | A * | 8/1990 | Royet et al. | 57/311 |
| 5,282,353 | A * | 2/1994 | Kellstrom, Jr. | 57/13 |
| 5,979,288 | A * | 11/1999 | Gallagher et al. | 87/36 |
| 5,983,617 | A * | 11/1999 | Nelson et al. | 57/3 |
| 5,996,216 | A * | 12/1999 | Varga | 29/714 |
| 6,662,808 | B2 * | 12/2003 | Leason et al. | 132/212 |
| 7,356,983 | B2 * | 4/2008 | Bieszczad et al. | 57/17 |

OTHER PUBLICATIONS

FOREIGN PATENT DOCUMENTS

GB 1 231 091 5/1971

OTHER PUBLICATIONS

International Search Report issued Aug. 22, 2008 in International (PCT) Application No. PCT/EP2008/053787.

International Preliminary Report on Patentability dated Aug. 12, 2009 in International (PCT) Application No. PCT/EP2008/053787.

Written Opinion of the International Searching Authority issued Aug. 22, 2008 in International (PCT) Application No. PCT/EP2008/053787.

* cited by examiner

*Primary Examiner* — Shaun R Hurley

(74) *Attorney, Agent, or Firm* — Wenderoth, Lind & Ponack, L.L.P.

(57) ABSTRACT

There is described a machine for the winding of tubular products, preferably with tensioned wires (8), including at least one disc (51-52) assembled to rotate on a base structure (2), a motor (9) adapted to drive the rotation of the disc (51-52, 101-103), a plurality of coils (3) assembled to rotate on supports (4) integral with said disc (51-52) and tensioning means (18, 30-31, 40-42), adapted to maintain the tension of the wires (8) constant during the winding of the tubular product (20). Said machine also includes a plurality of driving motors (5) associated to respective coils (3), adapted to feed the wires (8) and operating means (70) and potentiometers (19), adapted to control the unwinding speed of the wires (8) from the coils (3), which are driven by the motors (5).

20 Claims, 10 Drawing Sheets

SPIRAL WINDING MACHINE WITH MOTORIZED COILS

The present invention relates to a spiral winding machine with motorized coils.

Spiral winding machines are generally used to wind around a rubber, thermoplastic or PTFE tube, steel, textile or composite material wires in variable quantities, which are determined on the basis of diameters or use working pressures, in order to considerably increase the features of resistance to the pressure of the tube itself.

This kind of machines is also used for the shielding or the protection of electrical cables or data transmissions, both to protect the cable from electromagnetic disturbances and to increase the abrasion resistance.

Spiral winding machines are generally formed by a steel or aluminium disc, which may be single or double on the basis of the number and size of the coils to be used and supported by a metal structure, on which the motor for the rotation of the discs themselves is assembled.

Supports, on which coils containing the wire used for the covering of the product are placed, are assembled in a circle on the discs at different levels.

The coils, either flanged or not, used for the spiraling, may be provided directly by the manufacturer of the wire, whether the wire is made of metal, textile or composite material, or they may be obtained after a rewinding operation, adapted to unwind the wire from the coils provided by the manufacturer and rewind the wire or plurality of wires on coils having different features with respect to the original ones. The rewinding is required when the coils of the machine are smaller or larger than the original ones, in order to better adapt them to the technical features of the spiral winding machine itself, or of the product to cover. Furthermore, it may occur that the size is the same, although the coil of the machine has different features, or the wire requires additional operations, so that rewinding is required.

The tension of the wires is generally obtained by applying a braking force on the coil, whose wire is drawn by the tube to wind in a translatory motion, by means of either mechanic, magnetic, electromagnetic, electric or pneumatic brakes, to which more or less sophisticated tension control systems are associated, in order to maintain the applied braking force as uniform and constant as possible, so that all wires have the same tension, as it is one of the main prerogatives to obtain a parallel deposition of the wires on the product to cover.

As the products to cover usually consist of non cured rubber, thermoplastic or PTFE tubes, i.e. materials displaying a low resistance to compression, the tensions to apply on the wires must be as low as possible, compatibly with the bending resistance of the wires themselves.

The main prerogative of spiral winding machines in order to obtain high production standards, is therefore the ability of the machine to rotate with the highest possible rotation speed, together with a containment capacity of the coils which needs to be the highest possible, although maintaining the application tensions of the wires relatively low and constant from a full to an empty coil, regardless of its position on the disc (the proximity to the rotation axis of the disc determines different inertia forces), as well as of the rotation speed of the disc.

The machines currently available on the market, using conventional braking systems and therefore subject to considerable tension variations of the wires according to the centrifugal force exerted on the coils during the rotation of the discs, automatically imply the maximum use limit of the machine itself, thus limiting either the size of the coils to be used, or the rotation speed of the discs, affecting in both cases the throughput of the machine, requiring considerable down times to change the coils, or limiting the rotation speed.

The current state of the art therefore allows to achieve average rotation speeds on the order of 60-70 revolutions with single wire coils weighing 7-8 kg, for a total of coils from 100 to 160 units, or 80-90 revolutions with multiple wire coils (3 to 6) weighing 20-30 kg, for a total of coils from 24 to 32 units.

U.S. Pat. No. 3,934,395 discloses a machine for winding tubular products.

It is the object of the present invention to provide a spiral winding machine allowing to increase both the quality and the amount of production, that is a machine allowing high rotation speeds, although maintaining a low and constant tension of the wires.

It is a further object of the present invention to provide a control process for the tensioning of the wires, adapted to maintain a low and constant tension of the wires, even at high rotation speeds.

According to the invention, said object is achieved by a machine as disclosed in claim 1.

These and other features of the present invention, will be more apparent in the following detailed description of a practical embodiment thereof, shown by no way of limitation in the accompanying drawings, in which.

Figure 1:
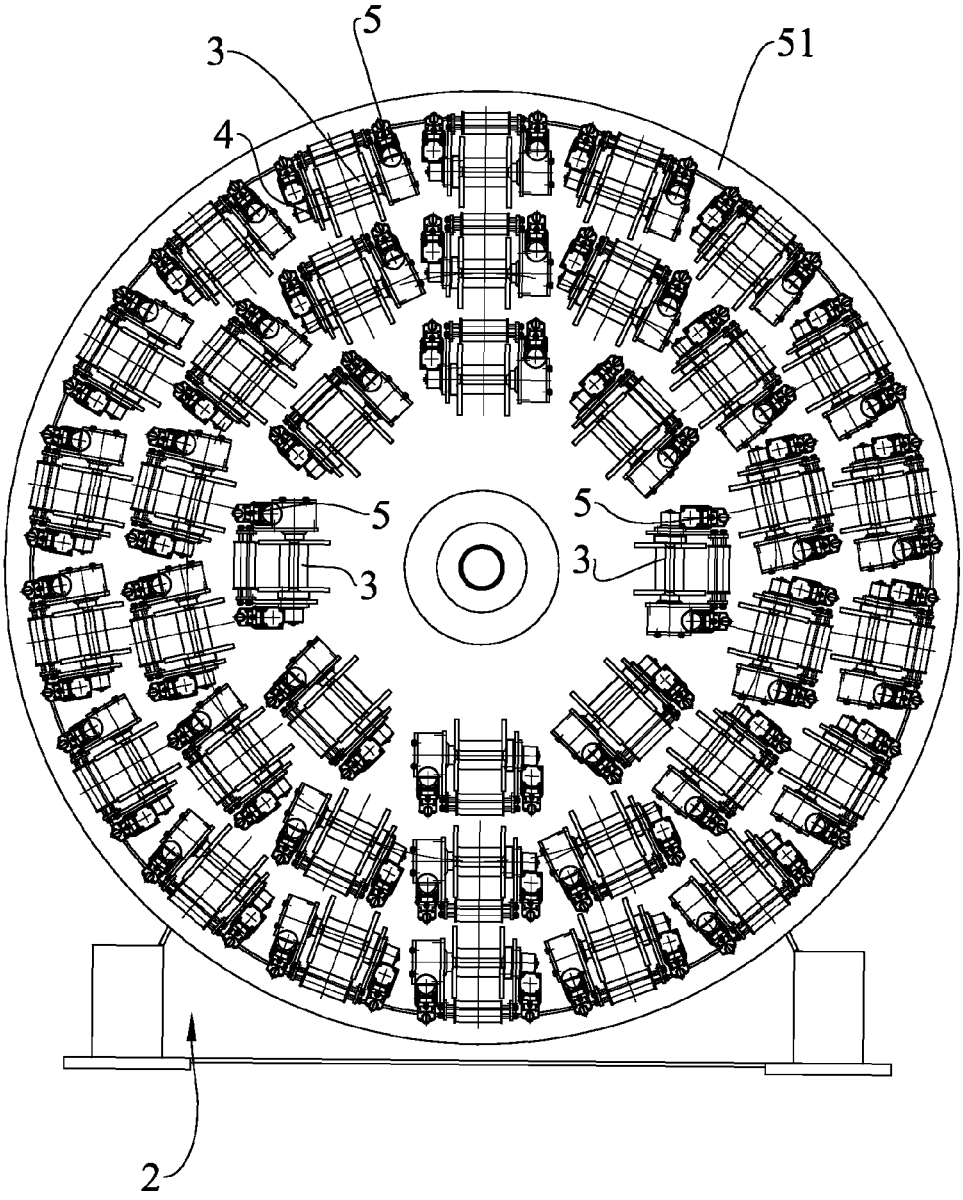
FIG. 1 shows a front view of a spiral winding machine according to a first embodiment of the present invention.
Figure 2:
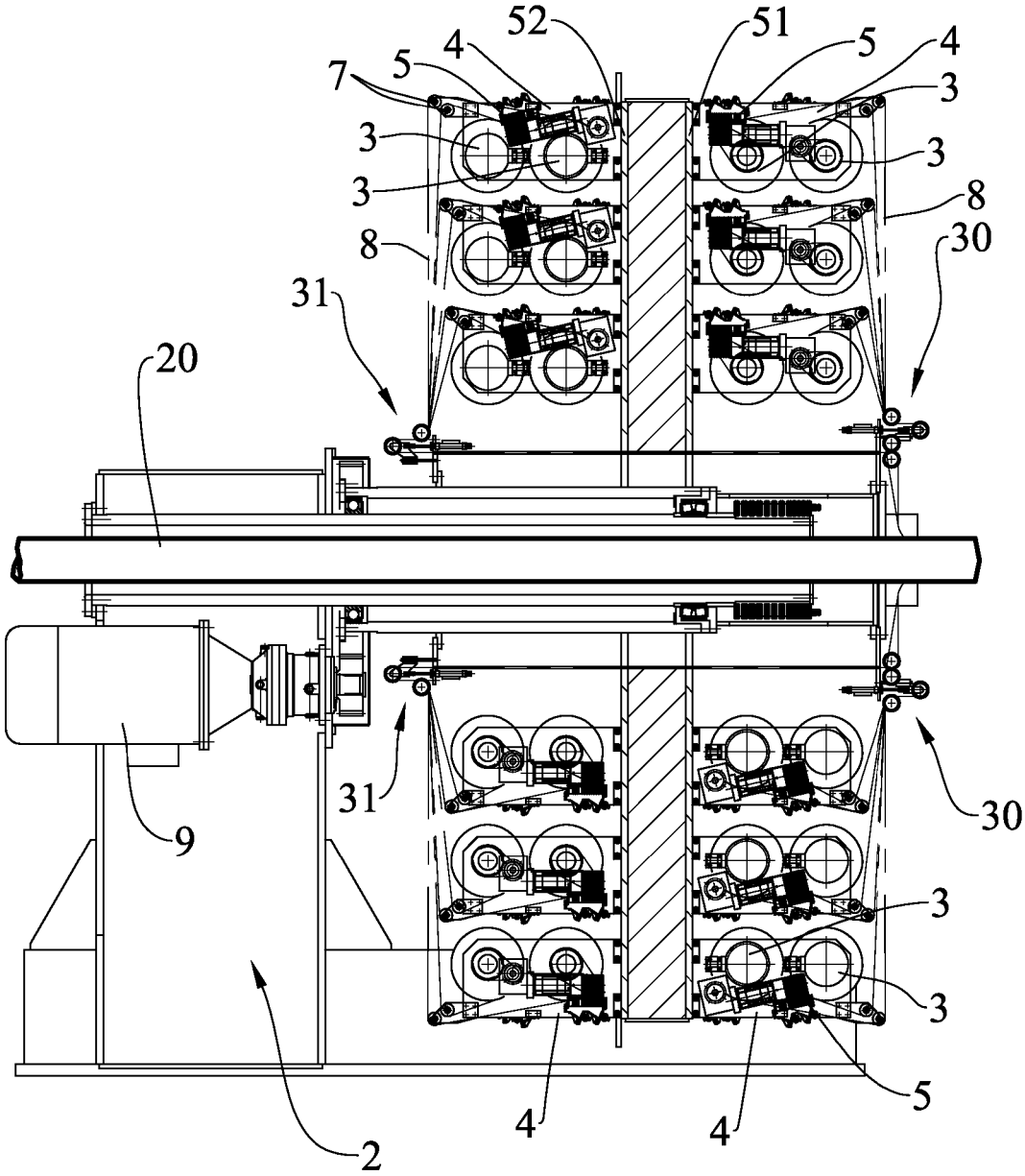
FIG. 2 shows a side section view of the machine in FIG. 1.
Figure 3:
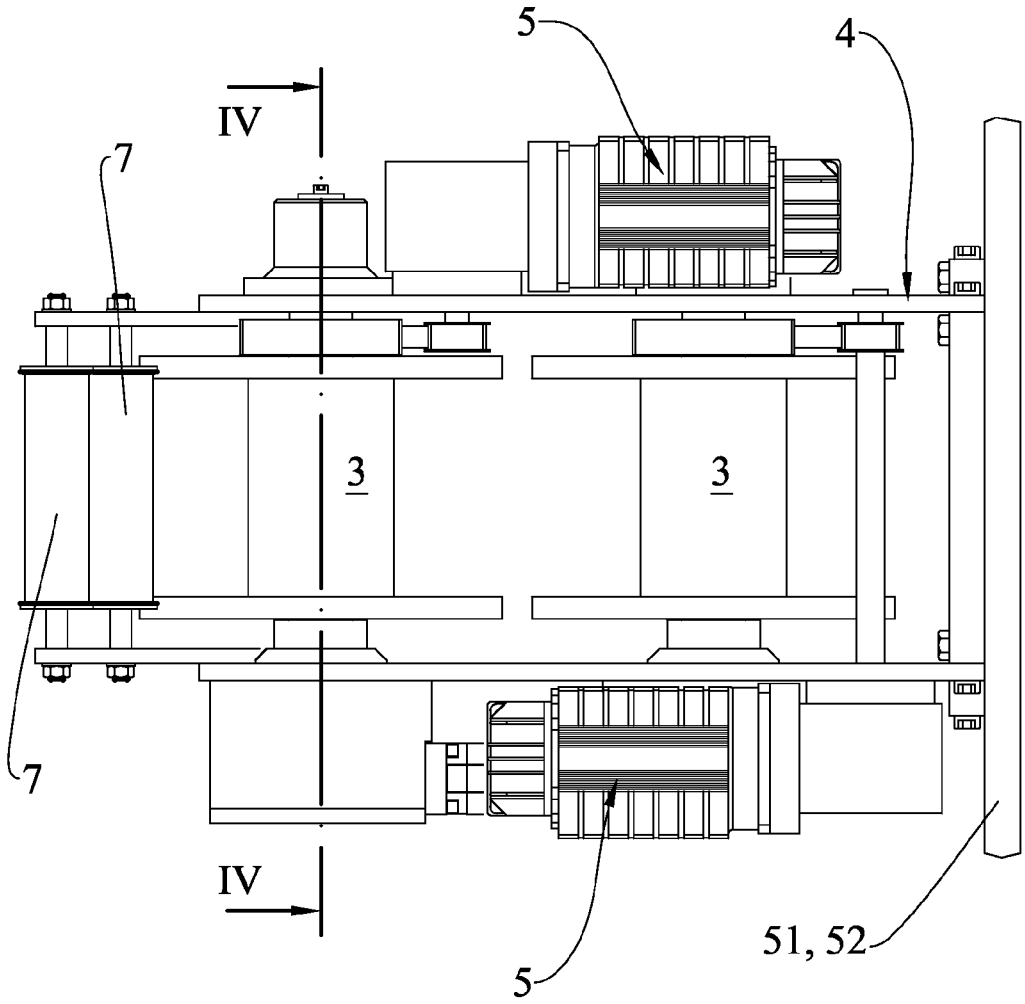
FIG. 3 shows an enlarged top plan view of a pair of coils with respective support and respective motors.
Figure 4:
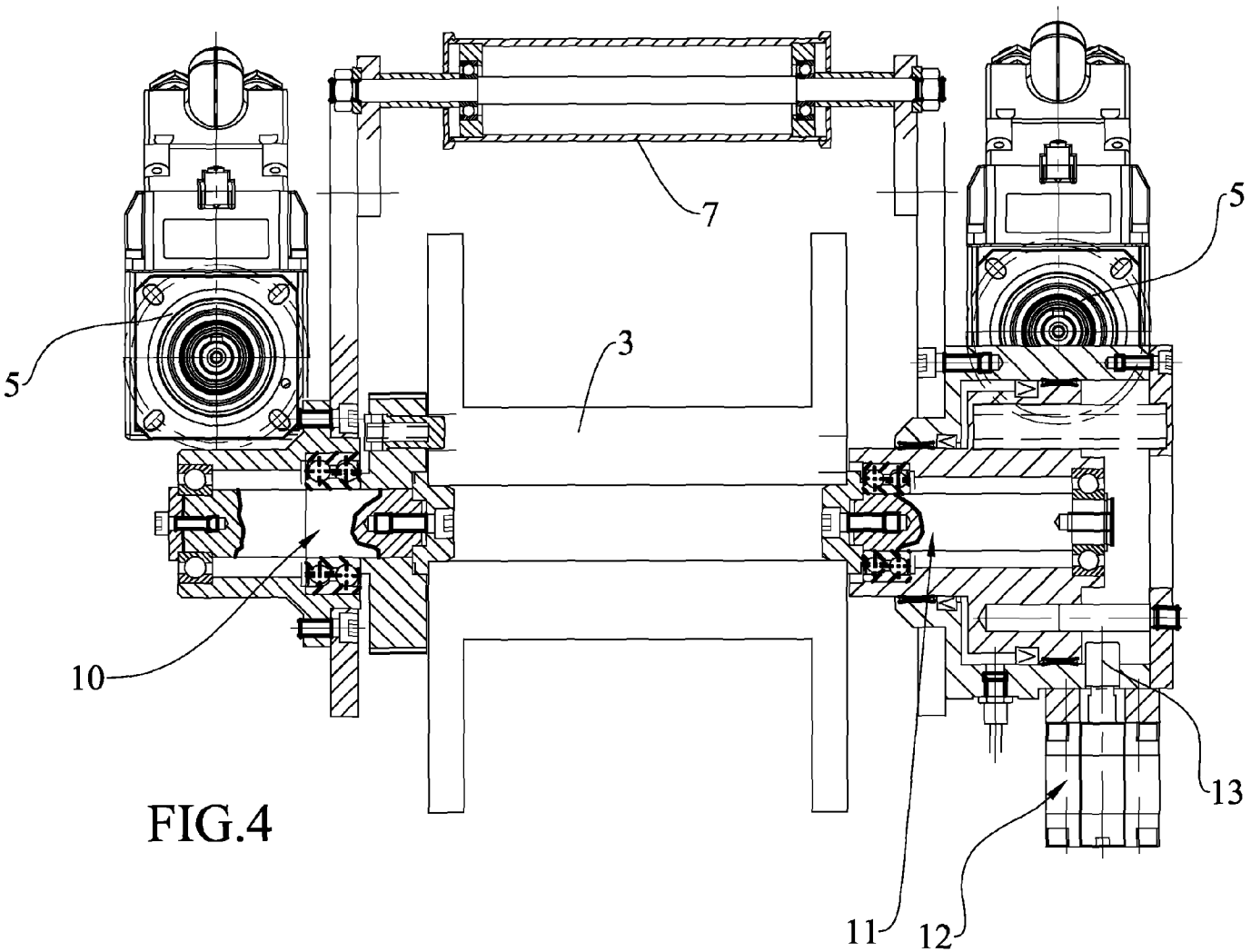
FIG. 4 shows a section view along line IV-IV line in FIG. 3.
Figure 5:
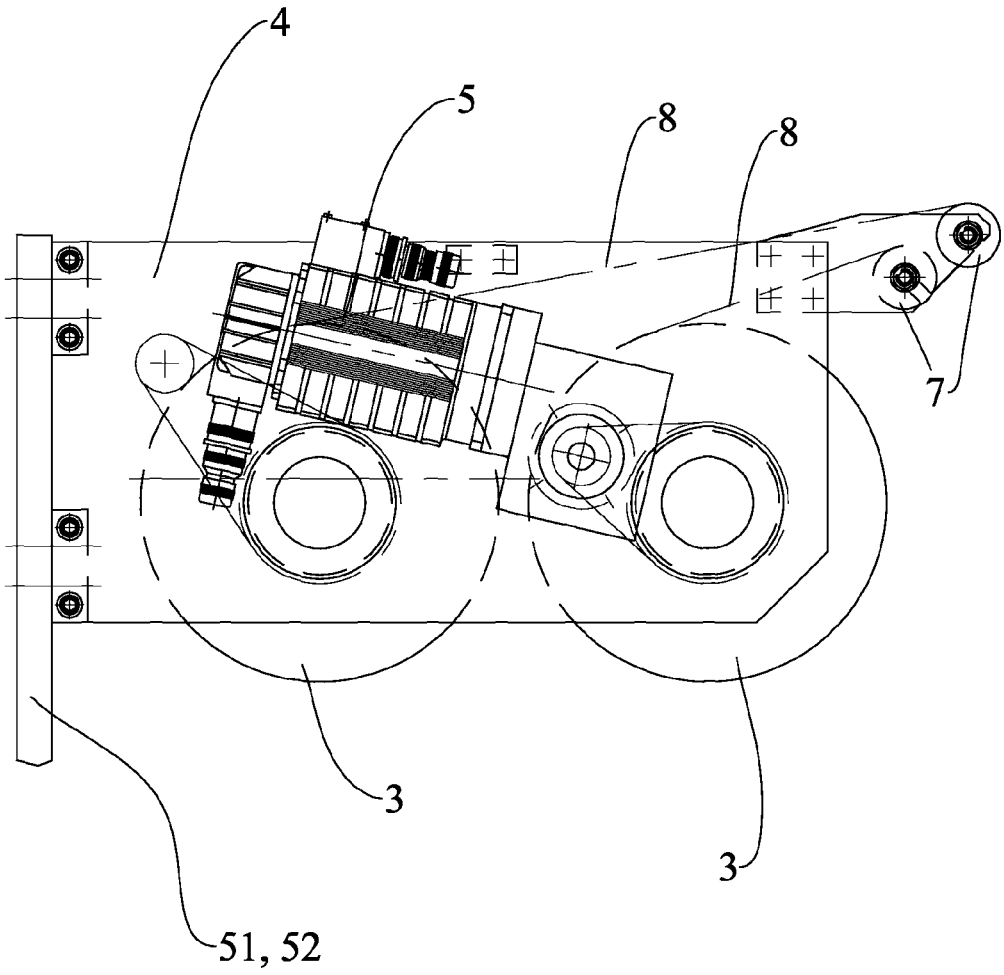
FIG. 5 shows a right side view of the object in FIG. 3.
Figure 6:
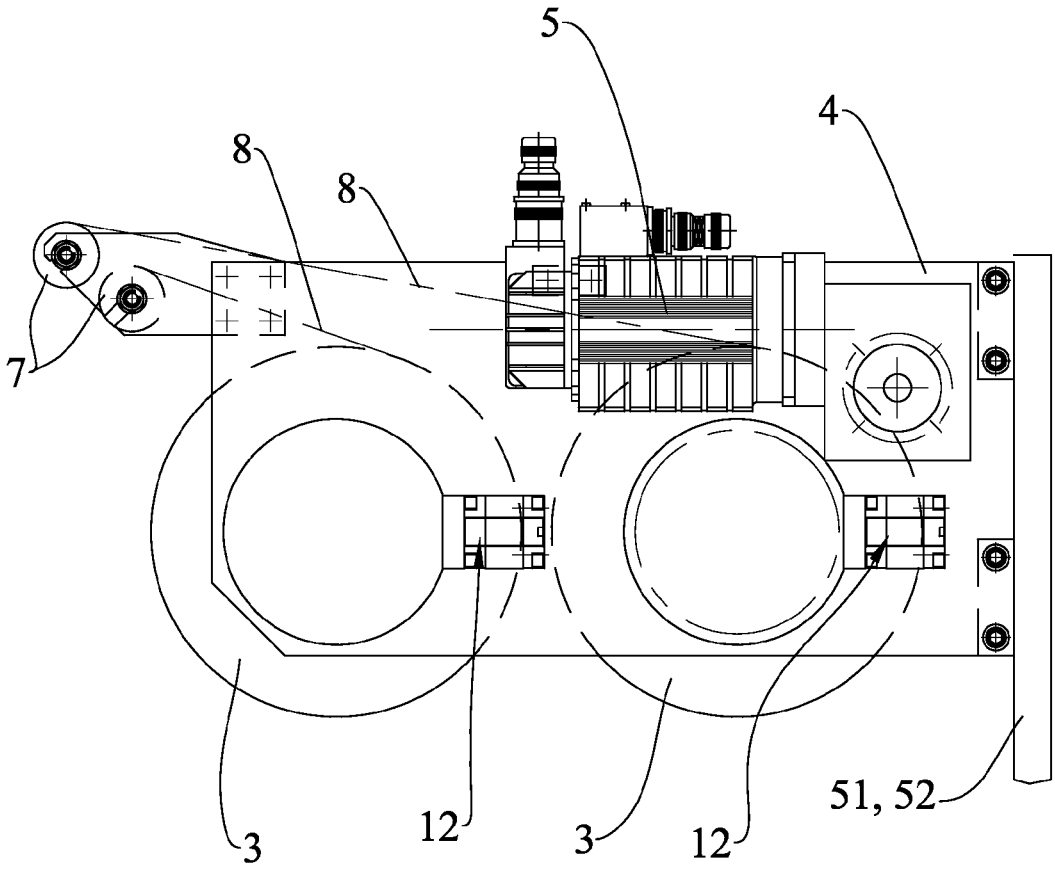
FIG. 6 shows a left side view of the object in FIG. 3.

The spiral winding machine shown in FIGS. 1-7 includes a pair of opposite coupled discs 51-52 (FIG. 2) assembled to rotate, with a horizontal rotation axis, on a metal structure 2, and a plurality of coils 3, assembled to rotate two by two on supports 4 (FIG. 3).

Each coil 3 is driven by a dedicated motor 5, each support 4 supporting two coils 3 and two motors 5.

Each support 4 includes a pair of guide rollers 7 for wires 8 (or wire strips), to be wound around a translating tube 20 driven by a take-off unit (not shown).

The wires 8 or the wire strips have a variable size depending on the tubes 20 to cover.

A motor 9 drives the rotation of the discs 51-52.

An assembly point 10 and tailstock 11 with a pneumatic locking device 12 including a locking piston 13 are provided for each coil 3.

Figure 7:
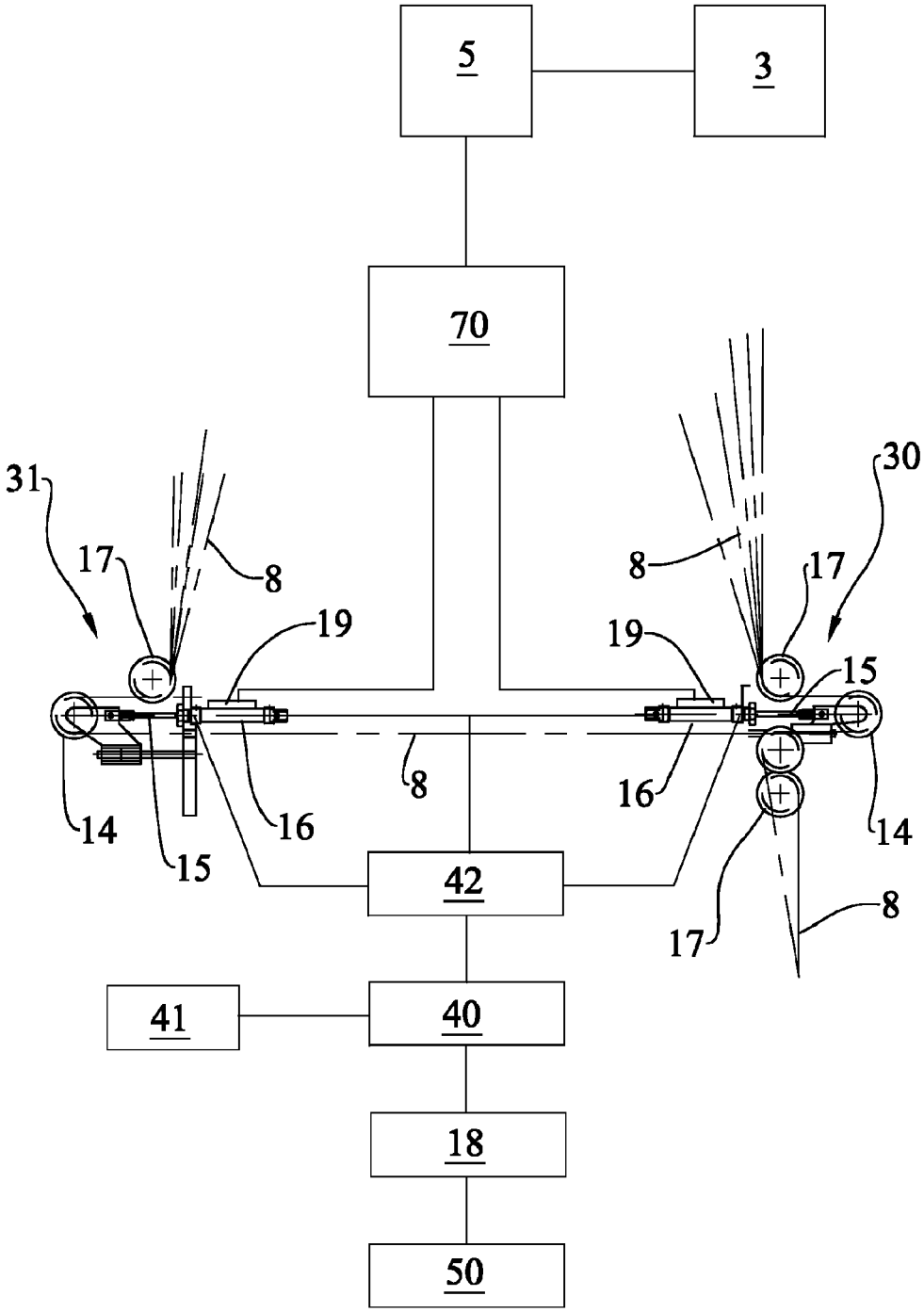
FIG. 7 shows a diagrammatic view of the tensioning system for the wires.

The machine according to the present invention also includes a plurality of main tensioning assemblies 30 (for the coils 3 of the disc 51) and transmission tensioning assemblies 31 (for the coils 3 of the disc 52), including translating pulleys 14 pivoting on cursors 15 connected to pistons of pneumatic cylinders 16, and guide pulleys 17. Said pulleys 14 and 17 rotate with the discs themselves 51-52 (FIG. 7).

The spiral winding machine according to the invention also includes a pneumatic tank 18 (diagrammatically shown in FIG. 7) fed by a pneumatic compressor 50, a proportional valve 40, an external potentiometer 41, which allows to set the air pressure by operating on the proportional valve, and an air chamber or tank 42 which conveys and receives the air from the cylinders 16 associated to the cursors 15. A potentiometer 19 controls the rotation speed of the motor 5, and therefore the rotation of the coil 3, by means of a driver 70, therefore cooperating to maintain a constant tension of the wires 8.

As far as the operation is concerned, the following working parameters are set at the beginning, on the basis of the translation speed of the tube 20 (productivity) and the tension of the wire 8 required:

rotation speed of the discs 51-52;

pressure in the cylinders 16.

The forward motion of the tube 20 connected to the wires 8 will determine the compression of the cursors 15 pushed by the pulleys 14, which determines the unwinding tension thereof by compressing the air inside the pistons, whereas, by detecting the position of the cursor 15 by means of the driver 70, the potentiometer 19 controls the rotation speed of the motor and therefore of the coil associated thereto, and therefore the unwinding speed of the wire 8.

The invention is based on the fact that, by using a motor 5 for each coil 3, therefore rotating the coil 3 containing the wire 8 with a thrust generated by an electric motor 5, instead of operating on the coil 3 with a braking system, all mechanical resistances directly affecting the tension of the wire or wires and exponentially increasing as a function of the rotation speed (and therefore as a function of the centrifugal force), are eliminated. These mechanical resistances mainly include the weight of the coil 3 and its variation during unloading, resistance to the rolling of the bearings and of all mechanical devices adapted to control the rotation of the coil.

Therefore, such elements have a direct correlation with the torque required to rotate the coil by pulling the wire wound on itself, thus determining the minimum tension on the wire.

This has an even greater relevance because such forces have a different incidence depending on the position of the coils themselves on the discs 51-52 (FIG. 1), as the coils are arranged in a circle around the discs 51-52 and on circles having different diameters so as to allow the installation of the number of coils required for the covering of the products.

Therefore, the coils 3 nearest to the centre of the discs 51-52 are subject to a much lower centrifugal force than the coils on the outside of the disc, thus determining tension imbalances among the wires wound on the coils closest or farthest from the centre of the machine.

By motorizing the rotation of the coil 3 and therefore by eliminating the influence that such forces exert on the control of the tension of the wires, particularly low unwinding tensions (close to zero) may be obtained, as the wire is fed and not slowed down independently of the weight of the coil, its position on the support disc and the rotation speed of the disc.

As previously described, the control of the tension on the wire or wires is therefore exerted by means of tensioning assemblies 30-31. Each pneumatic cylinder 16 varies its resistance to traction on the basis of the pressure of the air introduced by means of the tank 42 and of the proportional valve 40, thus determining the tension exerted on the wire or wires itself/themselves.

The potentiometer 19 placed on each tensioning assembly 30-31 detects the position of the cursor 15 connected to the piston of the cylinder 16 and determines the rotation speed of the coil 3 maintaining it constant independently of the length of the wire wound on the coil, on the basis of the rotation speed of the disc 1 and on the speed of forward motion of the tube 20, thus determining the unwinding linear speed of the wire.

Therefore, the system allows to obtain tension on the wires on the order of a few grams, preferably 100-200 grams, up to high tensions, which may reach several kilograms, preferably 10-15 kilograms, for larger wires, by simply regulating the pressure of the air introduced into the cylinder 16 by means of the proportional valve 40 controlled by the potentiometer 41.

The integration of the various elements therefore allows to maintain the set tension at a constant value from an empty to a full coil.

Such regulation may take place by means of an external control both before and during the operation steps, therefore both when the machine is standing and when the machine is rotating.

The tank 42 (diagrammatically shown in FIG. 7) is placed on the coil 3-holder disc 51-52 and draws or provides the air according to the position of the piston (and therefore of the cursor 15) with respect to its chamber, allowing to maintain the same air pressure within the pneumatic cylinders 16 among the various cylinders regardless of the position of the piston with respect to its chamber, thus levelling the tension of the wires 8 from the various coils 3, which are installed on the disc, regardless of the position of the cursor 15.

The peculiarity of the invention consists in the possibility of not only using coils 3 having considerable size and therefore a much longer length of tubes 2, but also of using elevated rotation speeds, by eliminating the influence of the weight of the coils 3 on the tension of the wires 8, and therefore considerably increasing throughput, as well as considerably reducing the regulation times of the machine itself, as the rotation speed of said machine may be varied both while operating and during preparation without the tension parameters on the wires 8 being altered, and as the tension on the wires 8 may be varied both when the machine is standing and during rotation, without the unwinding speed of the wire or wires 8 being affected in any way.

The system may be applied both to spiraling lines with single wires (one wire per coil) and with multiple wires (multiple wires for each coil, usually from 3 to 6 units).

The metal structure 2 may therefore consist of an electrowelded steel head, on which the drive motor adapted to rotate of the discs is assembled, the rotation of the discs occurring either by means of a toothed drive belt or by means of a cascade of gears.

Two opposite and inversely rotating discs may therefore be installed on such a structure 2 in the case of spiral winding machines provided with multiwire coils displaying 24 or 32 coils placed on each disc, or two coupled discs rotating in the same direction, in the case of single wire, as described in the present embodiment.

In this case, the coils will be assembled both on the front disc 51 and on to the rear disc 52, and the wires 8 of the rear disc 52 are driven and grouped on the front part of the machine, together with the wires coming from the front disc 51, where the wire drive bushes adapted to deposit the wires themselves on the tubes are placed. When using single wire coils, the most commonly used compositions are 103- 106- 120- 144- 160 wires, but not only limited to these, because the machine may easily be configured in accordance with specific market requirements, the machine being in fact based on an assembling concept.

From the data gathered during the tests performed on a prototype with the use of commonly employed and widespread BP60-type coils having a flange diameter of 254 mm and a total weight of the wire contained therein corresponding to 28 kg, by using a high resistance steel wire with a diameter of 0.6 mm, the efficiency of the invention in considerably increasing both the values of the rotation speed and the control of the tension has been demonstrated.

By way of example, it may be stated that the system has allowed to achieve a rotation speed of 110 revolutions per minute, with double discs provided with a total of 160 BP-type coils, wound with a high resistance single steel wire, or a rotation speed of 140 revolutions per minute, with double discs equipped with a total of 103 BP60-type coils, wound with a high resistance single steel wire.

Therefore, said features allow considerable manufacturing advantages, in particular for the manufacturing of high or very high pressure rubber, thermoplastic or PTFE hydraulic tubes, for instance, following the EN 856 4SP-EN856 4SH-EN 856 R12-R13-R15-SAE 100R9-R10-R12 R13 standards with reference to the technology currently on the market.

FIGS. 8-11 show a second embodiment of the spiral winding machine according to the present invention.

In comparison with the above described embodiment, the coils 3 together with the respective motors 5 are arranged according to horizontal rows parallel to the translation direction of the motion of the tube 20.

Figure 8:
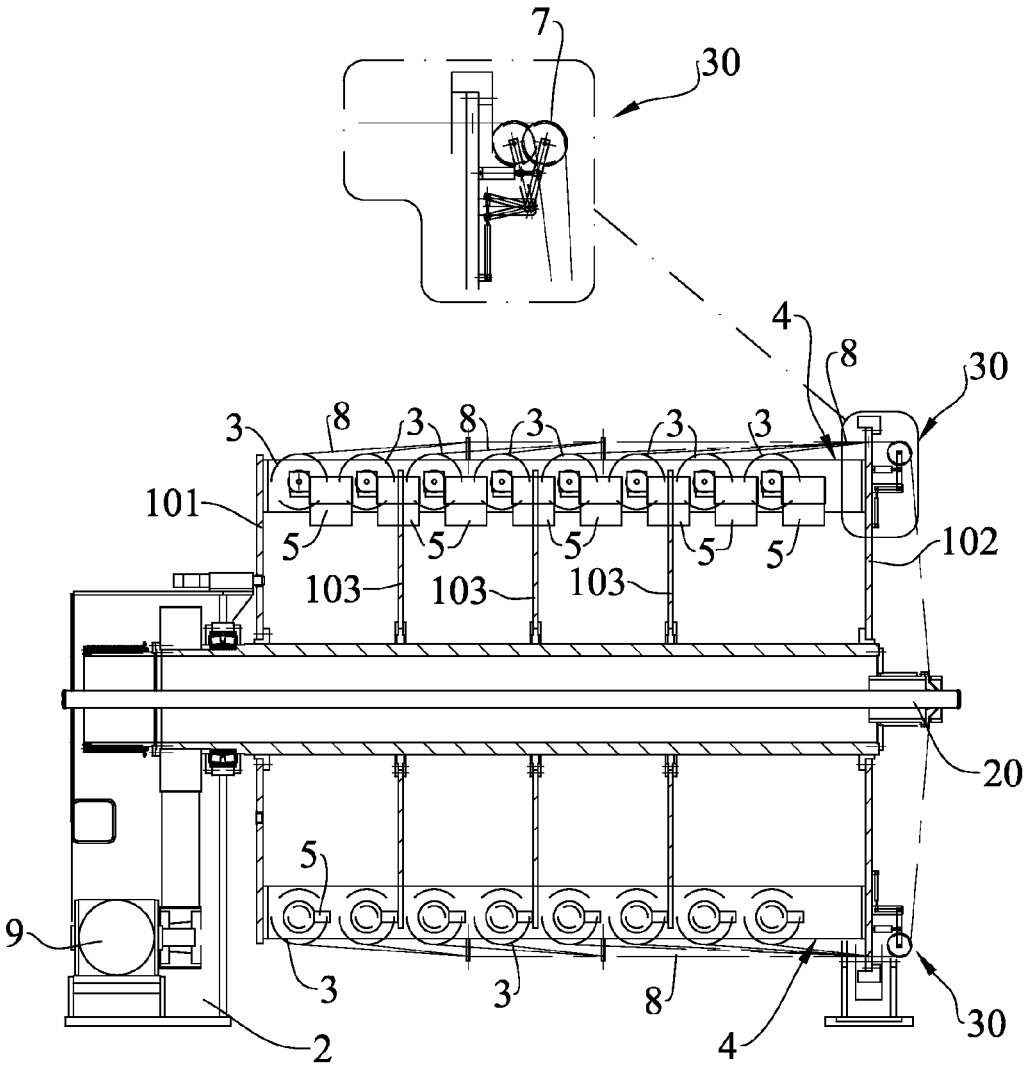
FIG. 8 shows a side section view of a second embodiment of the spiral winding machine according to the present invention.

The machine in FIG. 8 indeed includes a front disc 101, a rear disc 102 and three intermediate discs 103. Said discs drive the rotation of horizontal supports 4 which support eight coils 3 with respective motors 5.

Figure 9:
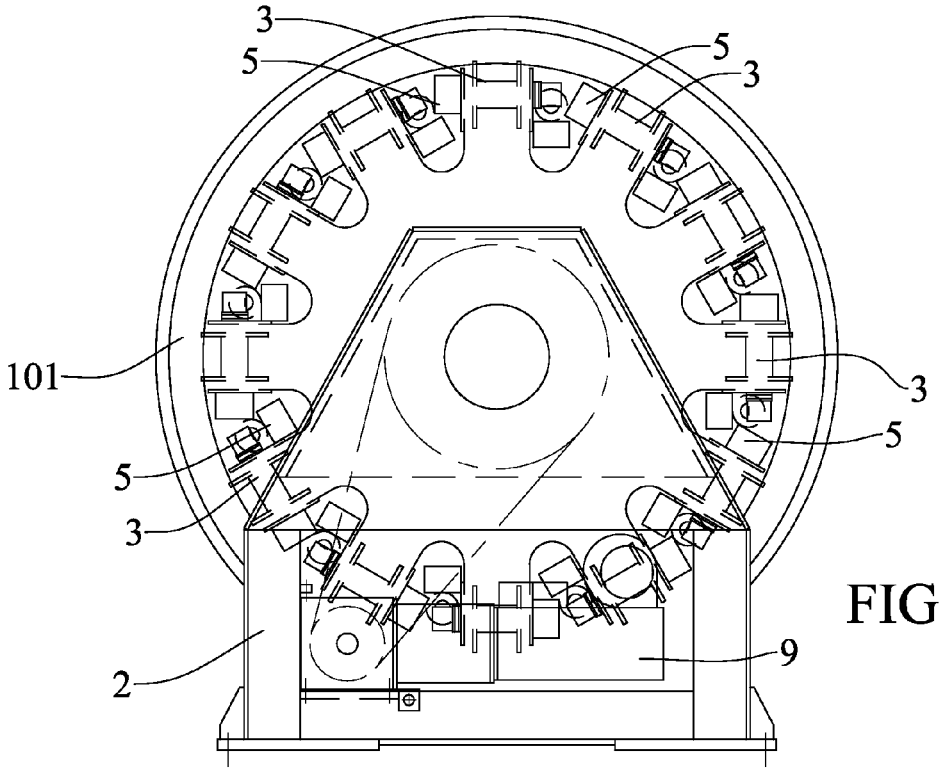
FIG. 9 shows a left view of the machine in FIG. 8.
Figure 10:
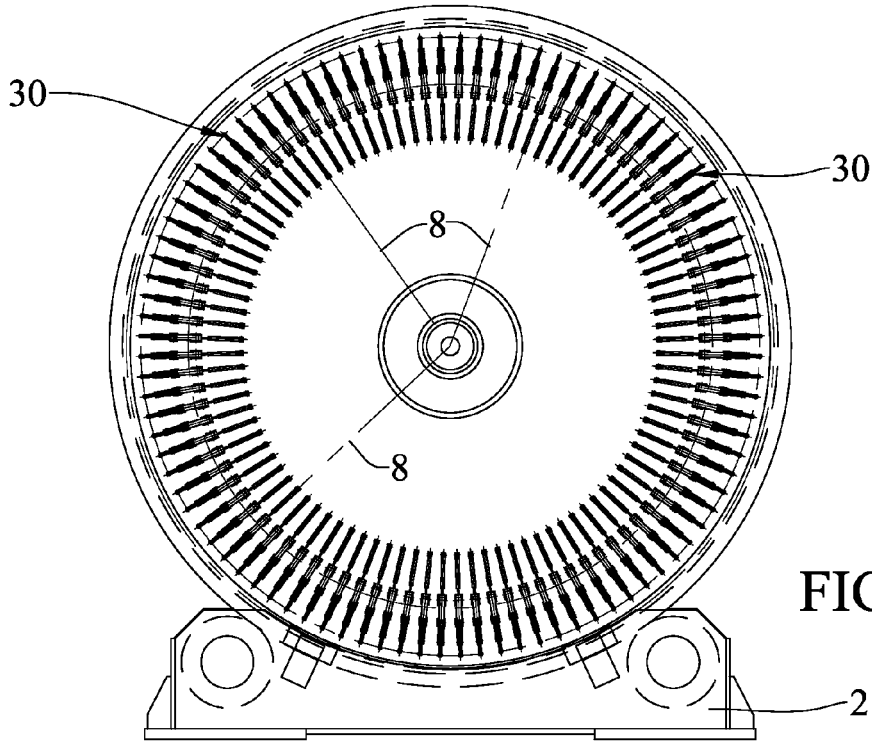
FIG. 10 shows a right view of the machine in FIG. 8.
Figure 11:
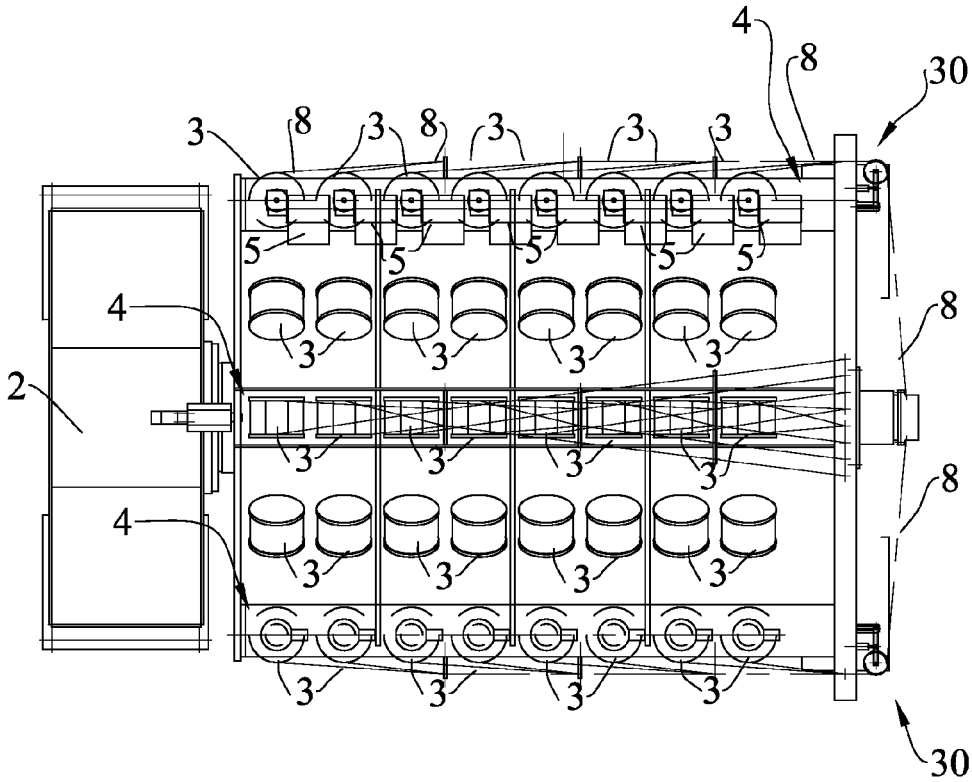
FIG. 11 shows a top plan view of the machine in FIG. 8.

FIG. 9 shows that the present machine includes twelve rows of eight coils 3 and motors 5 arranged at a constant angular distance towards the outer part of the discs 101-103.

The operation is similar to that described for the previous embodiment.

The only difference relates to the presence of only main tensioning assemblies 30. There are no transmission tensioning assemblies 31 with a subsequent greater operation ease for the wires. The path of the wires 8 is much simpler.

This second arrangement advantageously allows to use smaller discs and therefore allows a reduction of the inertial forces involved.

For machines requiring a greater number of coils 3, the number of coils 3 and respective motors 5 for each support 4 may be increased or the number of peripheral supports 4 may be increased therefore increasing the diameter of the discs 101-103.

The invention claimed is:

1. A machine for the winding of tubular products (20) with tensioned wires (8) including, at least one disc (51-52, 101-103) assembled to rotate on a base structure (2), a motor (9) adapted to drive the rotation of the disc (51-52), a plurality of coils (3) assembled to rotate on supports (4) integral with said disc (51-52, 101-103), and tensioning means (18, 30-31, 40-42) adapted to maintain a constant tension of the wires (8) during the winding of the tubular product (20), characterized in that it also includes a plurality of driving motors (5) mounted on said at least one disc (51, 52, 101-103) associated one by one to their respective coils (3) adapted to feed the wires (8), and operation means (70), pneumatic means (18, 50) and a plurality of potentiometers (19) associated one by one to respective coils (3) adapted to control the unwinding speed of the wires (8) from the coils (3), which are driven by the motors (5).

2. A machine according to claim 1, characterized in that it includes:

a pneumatic tank (18) fed by a pneumatic compressor (50), a proportional valve (40), an external potentiometer (41), which operates on the proportional valve (40), allowing to set the air pressure in pneumatic cylinders (16), associated to cursors (15) on which pulleys (14) are pivoted, an air tube (42), which serves as a tank which conveys and receives air from the pneumatic cylinders (16), potentiometers also being provided (19) which control the rotation speed of the motors (5) and therefore the rotation of the coils (3) by means of operating means (70), thus cooperating to maintain a constant tension of the wires (8).

3. A machine according to claim 1, characterized in that it includes a plurality of the horizontal supports (4), on which there are assembled the plurality of coils (3) and respective motors (5), which are mounted on the periphery of two or more separate discs (101-103) at a constant distance from the centre of the discs (101 -103) and at a reciprocally constant angular distance.

4. A machine according to claim 3, characterized in that it comprises twelve supports (4) for eight coils (3) and eight motors (5).

5. A machine according to claim 1, characterized in that it includes a plurality of horizontal supports (4), on which there are assembled two coils (3) and two motors (5), which are assembled on a single disc (51, 52) so as to substantially cover the whole surface of the disc (51, 52).

6. A machine according to claim 5, characterized in that it includes a pair of opposite coupled discs (51-52) which rotate in the same direction.

7. A machine according to claim 5, characterized in that it includes a pair of opposite discs which rotate in an inverse direction.

8. A machine according to claim 5, characterized in that it includes a plurality of main (30) and transmission (31) tensioning assemblies.

9. A machine according to claim 1, characterized in that the rotation axis of the coils (3) is perpendicular to the axis of the disc (51-52, 101-103).

10. A machine according to claim 2, characterized in that it includes a plurality of the horizontal supports (4), on which there are assembled the plurality of coils (3) and respective motors (5), which are mounted on the periphery of two or more separate discs (101-103) at a constant distance from the centre of the discs (101-103) and at a reciprocally constant angular distance.

11. A machine according to claim 2, characterized in that it includes a plurality of horizontal supports (4), on which there are assembled two coils (3) and two motors (5), which are assembled on a single disc (51, 52) so as to substantially cover the whole surface of the disc (51, 52).

12. A machine according to claim 6, characterized in that it includes a plurality of main (30) and transmission (31) tensioning assemblies.

13. A machine according to claim 7, characterized in that it includes a plurality of main (30) and transmission (31) tensioning assemblies.

14. A machine according to claim 2, characterized in that the rotation axis of the coils (3) is perpendicular to the axis of the disc (51-52, 101-103).

15. A machine according to claim 3, characterized in that the rotation axis of the coils (3) is perpendicular to the axis of the disc (51-52, 101-103).

16. A machine according to claim 4, characterized in that the rotation axis of the coils (3) is perpendicular to the axis of the disc (51-52, 101-103).

17. A machine according to claim 5, characterized in that the rotation axis of the coils (3) is perpendicular to the axis of the disc (51-52, 101-103).

18. A machine according to claim 6, characterized in that the rotation axis of the coils (3) is perpendicular to the axis of the disc (51-52, 101-103).

19. A machine according to claim 7, characterized in that the rotation axis of the coils (3) is perpendicular to the axis of the disc (51-52, 101-103).

20. A machine according to claim 8, characterized in that the rotation axis of the coils (3) is perpendicular to the axis of the disc (51-52, 101-103).

* * * * *